United States Patent [19]

Bernard

[11] Patent Number: 4,824,703

[45] Date of Patent: Apr. 25, 1989

[54] LEATHER OF FABRIC ARTICLE INCORPORATING AN ATTACHED TRIMMING

[75] Inventor: Lehmann Bernard, Saint Cloud, France

[73] Assignee: Chanel, Hauts-de-Seine, France

[21] Appl. No.: 749,706

[22] Filed: Jun. 28, 1985

[30] Foreign Application Priority Data

Jun. 29, 1984 [FR] France ..... 84 10307

[51] Int. Cl.[4] ..... F16B 2/00

[52] U.S. Cl. ..... 428/33; 150/132; 428/134; 428/142

[58] Field of Search ..... 150/132; 428/35, 33, 428/131, 134, 192; 29/428

[56] References Cited

U.S. PATENT DOCUMENTS 1,897,341 2/1933 Stauffert ..... 41/34

2,027,441 1/1936 Landis ..... 41/34

*Primary Examiner*—James J. Bell

*Attorney, Agent, or Firm*—Armstrong, Nikaido, Marmelstein & Kubovcik

[57] ABSTRACT

A trim member is fixed to one sheet wall of a two sheet article of fabric or leather made by cojoining the two sheets around their edges, by locating a rigid plate between the sheet walls, forming an opening in the one sheet wall to bear the trim member over the plate and providing the trim member with a tongue which enters the opening and sandwiches an area of the one sheet wall overlying the plate between the tongue and the trim member.

7 Claims, 1 Drawing Sheet

LEATHER OF FABRIC ARTICLE INCORPORATING AN ATTACHED TRIMMING

TECHNICAL FIELD

The invention relates to a leather or fabric article incorporating an attached trimming on one of its walls, and also to a process for attaching such a trimming onto the article. It relates more precisely to articles having two facing walls assembled together by their edges.

DISCUSSION OF PRIOR ART

Leather or fabric articles can be provided, in a manner known per se, with decorative or protective trimmings, especially in the form of small metal pieces. One of the means of attaching such a trimming onto a wall is to provide the trimming with semi-rigid lugs, which perforate the wall and are folded down at the back of this wall. Another means is to hook the trimming onto the edge of the wall: metal corners are thus attached in the corner regions of a wall, the edge of these corners gripping that of the wall.

These different means of attachment, and others, have the disadvantage of being visible, of masking some portions of the wall, such as the stitching line or a border edging the wall, in the case of metal corners. Moreover, they require some use of tools to carry out folding, crimping, riveting, and the like.

OBJECTS OF THE INVENTION

One of the objects of the invention is to propose an article having two facing walls and onto which a trimming is attached at any place on one of the walls, referred to as the bearing wall, the other wall being referred to as the non-bearing wall.

Another object of the invention is to propose such an article in which the means of attachment of the trimming onto the bearing wall are not visible.

An additional object of the invention is to propose such an article in which the trimming can be attached close to the region of assembly between the two walls, without covering this region, so as to leave visible the stitching line or a border provided in this area. Another object of the invention is to propose an article in which the means of attachment of the trimming needs virtually no use of tools.

SUMMARY OF THE INVENTION

To this end, the invention relates to a leather or fabric article having two facing walls assembled together by their edges, one of the walls constituting a bearing wall onto which a trimming is attached on its face opposite to the other wall. According to the invention, this trimming incorporates a rigid tongue folded back onto the trimming to form with it a clip, this tongue penetrating, through an incision in the bearing wall, between the two walls to grip the bearing wall, a rigid plate slightly larger in size than the tongue being situated, facing the tongue, against the face of the non-bearing wall which faces the bearing wall.

The plate is preferably attached by sticking it onto the non-bearing wall.

The invention also relates to a process for attaching a trimming onto a leather or fabric article having two facing walls assembled together by their edges, this process consisting in:

placing a rigid plate on the face of one of the walls situated facing the other wall, before assembling the two walls, assembling the two walls, performing an incision in the wall which does not bear against the plate, facing the plate and close to one of its edges, and sliding, through this incision and against the plate, a rigid tongue provided on the trimming and folded back onto the latter.

The expression "rigid tongue folded back onto the trimming" embraces many embodiments. It can, in particular, refer to a tongue attached parallel to and close to the trimming, in particular by welding one of its edges to the trimming. It can also refer to a tongue integral with the trimming which is turned back against the latter by folding. The tongue can also be machined or cast at the same time as the trimming, in its requisite position. This "rigid" tongue nevertheless possesses slight elasticity, which enables it to be shifted slightly away from the trimming.

BRIEF DESCRIPTION OF THE DRAWING

Other details and advantages of the invention will become clear during the description which follows of an embodiment given by way of a non-limitative example, with reference to the attached figures, wherein.

DESCRIPTION OF THE PREFERRED EMBODIMENTS

Figure 1:
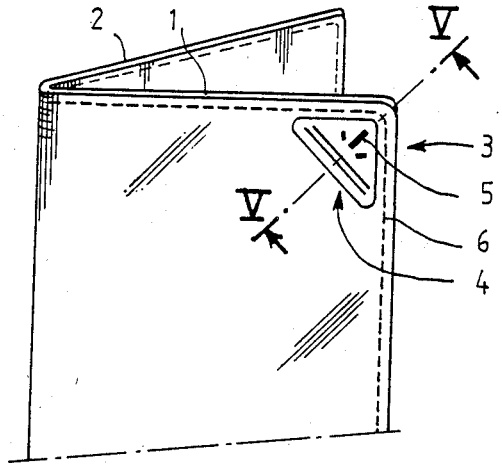
FIG. 1 is a partial perspective view of a billfold incorporating in a corner region a rigid corner arranged according to the invention.

FIG. 1 shows a billfold incorporating two flaps 1, 2 of generally rectangular shape. Each flap comprises an inner face facing the other flap, and an outer face. Onto the outer face of flap 1, and in one of its two corner regions 3, there is attached a metal corner 4, the object of which is to decorate or strengthen the corner region 3. The metal corner 4 can incorporate on its outer face, opposite that of flap 1, a decorative motif 5. The metal corner 4 is, according to this example of embodiment, triangular and incorporates a right angle, the edges of which are arranged parallel to the adjacent edges of the flap 1, but separated from these edges so as to leave visible a stitching line 6 or a decorative border running along the edges of the flap 1.

Figure 2:
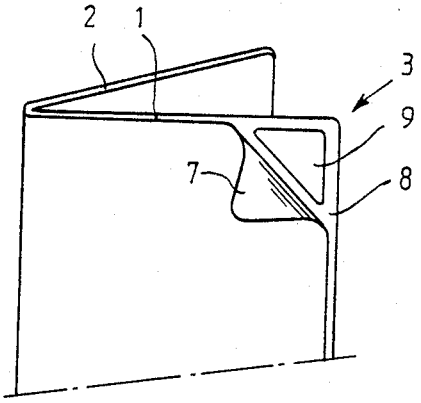
FIG. 2 is a partial perspective view of a billfold on which has been placed, before stitching, a rigid plate between its outer wall and its lining, for the purpose of fitting it with a rigid corner.

Flaps 1 and 2 of the billfold of FIG. 2 comprise an outer wall 7 and an inner wall 8 referred to subsequently as "lining", joined together. The outer wall 7 and the lining 8 are joined by stitching along their edges. Before stitching the outer wall 7 to the lining 8, and for the purpose of fitting the corner region 3 of the flap 1 with a metal corner, a metal plate 9 is stuck in this region against the face of the lining 8 situated facing the wall 7. This plate is triangular and incorporates a right angle. The right angle of the plate 9 is arranged facing the right angle of the flap 1, but it is, however, slightly offset toward the middle of flap 1.

Figure 3:
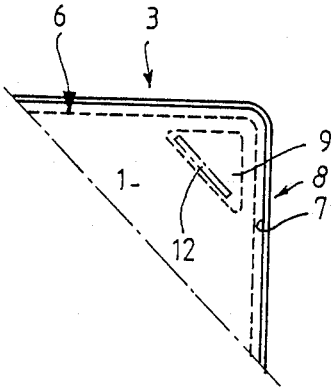
FIG. 3 is a plan view of the corner region of the billfold of FIG. 2, after stitching and incision.

FIG. 3 shows the flap 1 of the billfold when the outer wall 7 and the lining 8 have been stitched together along the stitching line 6 in the corner region 3. The stitching line 6 is parallel to the edge of the flap 1, and is interposed between this edge and the right angle of the plate 9. After the stitching has been carried out, an incision 12 is made in the outer wall 7 facing the plate 9, along a line parallel to the edge of this plate 9 not adjacent to the stitching line 6, and situated near this edge.

Figure 4:
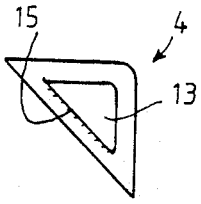
FIG. 4 is a view from the underside of a metal corner intended for attachment onto the billfold.

FIG. 4 shows a metal corner 4 intended for attachment onto the billfold. It is substantially identical in shape and size to the plate 9. The metal corner 4 is provided on its outer face with a coating of a decorative motif, and on its inner face with a metal tongue 13. The tongue 13 is similar in shape to the plate 9. However, it is slightly smaller in size than plate 9 and this enables it to pass through the incision 12 made in the outer wall 7. The tongue 13 is connected to the metal corner 4 by its edge 15 opposite to the right angle, in particular by welding, this edge 15 being arranged parallel to the corresponding edge of the triangular metal corner 4. The tongue 13 is folded down onto the metal corner 4 and forms a clip with it.

Figure 5:
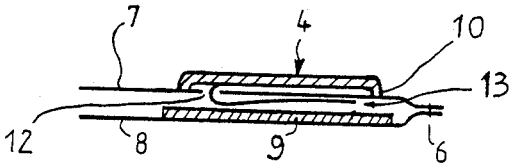
FIG. 5 is a sectional view according to line V—V of FIG. 1.

The corner 4 equipped with the tongue 13 is then attached onto the billfold (FIG. 5). Its tongue 13 is slid through the incision 12 and against the plate 9. In this operation, the presence of the plate 9 is essential, since it greatly facilitates the introduction of the tongue 13 and forestalls any distortion of the latter due to jamming. Furthermore, the plate 9, which extends beyond the tongue 13, endows the lining 8 with a completely flat contact surface by masking the area of attachment of the tongue 13 onto the corner 4. As regards the outer wall 7, it is elastically gripped between the corner 4 and its tongue 13, and this guarantees effective immobilization of this corner 4 on the billfold, especially if the corner 4 is provided with a peripheral shoulder 10 projecting toward the wall 7 and clinging onto the latter.

As a variant to the embodiment described above, the corner can be fastened onto the lining of the article so as to be visible from the inside of the article. The corner can consist of any rigid material, or even of a non-rigid material provided that its tongue has sufficient rigidity to grip the wall in combination with it. As regards the article onto which the corner is attached, it can be made of leather, natural or synthetic fabric, and even of plastic or semi-rigid elastomer.

What is claimed is:

1. In combination a sheet-formed article and a trim member attached thereto, wherein said sheet formed article has two facing sheet walls secured together at the edge thereof, one of said walls being a bearing wall having a slit therein, and wherein said trim member has a tongue extending generally parallel thereto to form a clip and is attached to said bearing wall, such that said tongue extends through said slit and to be positioned between said walls and to grip said bearing wall between said tongue and said trim member.

2. An article according to claim 1, wherein a plate is provided on an inner surface of the non-bearing wall which faces the inner surface of said bearing wall.

3. The article according to claim 2, wherein said plate is larger in size than said tongue.

4. The article as claimed in claim 2, wherein said plate is attached by sticking it onto said non-bearing wall.

5. An article as claimed in claim 1, wherein the bearing sheet wall is of leather.

6. An article as claimed in claim 1, wherein the bearing sheet wall is of fabric.

7. An article as claimed in claim 1, wherein the trim member is of generally triangular shape and is located in a corner region of the article with the apex of triangular shape facing the corner of the said corner region.

* * * * *

UNITED STATES PATENT AND TRADEMARK OFFICE

CERTIFICATE OF CORRECTION

PATENT NO. : 4,824,703

DATED : April 25, 1989

INVENTOR(S) : Bernard LEHMANN

It is certified that error appears in the above-identified patent and that said Letters Patent is hereby corrected as shown below:

On the cover page, under Item [19], "Bernard" should read --Lehmann--;

Item [54], the title should read --LEATHER OR FABRIC ARTICLE INCORPORATING AN ATTACHED TRIMMING--;

Item [75], "Lehmann Bernard" should read --Bernard Lehmann--.

Column 1, lines 2, "LEATHER OF" should read --LEATHER OR--.

Signed and Sealed this

Fourteenth Day of November, 1989

*Attest:*

JEFFREY M. SAMUELS

*Attesting Officer*

*Acting Commissioner of Patents and Trademarks*